United States Patent [19]

Bauer

[11] Patent Number: 4,680,872

[45] Date of Patent: Jul. 21, 1987

[54] YARN HEATING APPARATUS AND METHOD

[75] Inventor: Karl Bauer, Remscheid, Fed. Rep. of Germany

[73] Assignee: Barmag AG, Remscheid, Fed. Rep. of Germany

[21] Appl. No.: 836,257

[22] Filed: Mar. 5, 1986

[30] Foreign Application Priority Data

Mar. 5, 1985 [DE] Fed. Rep. of Germany ..... 3507642
Apr. 25, 1985 [DE] Fed. Rep. of Germany ..... 3514874

[51] Int. Cl.[4] ..... F26B 13/02

[52] U.S. Cl. ..... 34/23; 34/156; 34/155; 34/41

[58] Field of Search ..... 34/23, 54, 49, 155, 34/156, 41; 28/248, 255, 272

[56] References Cited

U.S. PATENT DOCUMENTS 2,708,843 5/1955 Gibson et al. .
3,298,430 1/1967 Kodaira .
3,606,655 9/1971 Oberlander et al. ..... 34/155
3,633,256 1/1972 Mallonee et al. ..... 34/155
3,883,718 5/1975 Ferment et al. ..... 34/155
4,001,548 1/1977 Bauer .
4,135,511 1/1979 Nikkel ..... 28/248
4,198,835 4/1980 Luthi .
4,226,092 10/1980 Luthi .
4,549,361 10/1985 Brough et al. ..... 34/155

FOREIGN PATENT DOCUMENTS 3306459 9/1983 Fed. Rep. of Germany .

*Primary Examiner*—Larry I. Schwartz
*Attorney, Agent, or Firm*—Bell, Seltzer, Park & Gibson

[57] ABSTRACT

A yarn heating apparatus and method is disclosed which is adapted for the continuous heat treatment of a running synthetic yarn in a yarn false twist texturizing machine or the like. The apparatus includes a yarn guide tube through which the running yarn is conducted, and a surrounding heater box is provided for heating the exterior of the yarn guide tube so as to heat the running yarn as it is conducted therethrough. Also, air supply means is provided for positively introducing outside ambient air into the yarn guide tube adjacent the entry end thereof, and such that turbulence is produced in the air as it moves through the yarn guide tube to thereby improve heat transfer between the tube and the running yarn.

15 Claims, 2 Drawing Figures

YARN HEATING APPARATUS AND METHOD

Figures 1, 2:
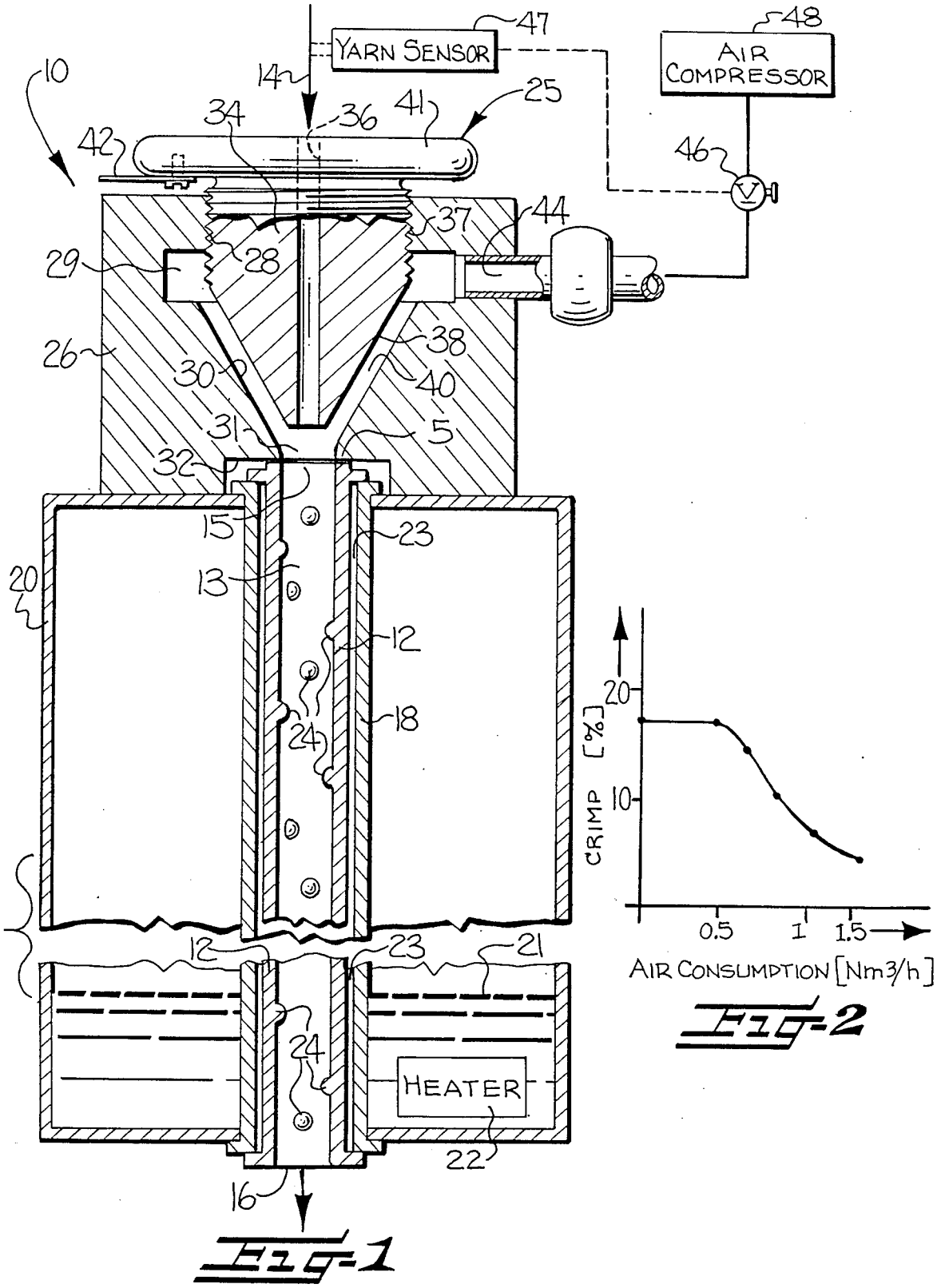

The present invention relates to a heating apparatus and method for the heat treatment of synthetic multifilament yarns in a yarn processing machine, such as a yarn false twist texturizing machine or an air jet texturizing machine.

Heating means of various designs have been employed for treating thermoplastic multifilament yarn in texturizing or crimping machines, and wherein the yarn is guided through a tubular, closed heating chamber which receives hot air. Thus for example, in the case of a texturizing machine having a single heater for thermosetting each yarn, the heater usually precedes a false twist imparting means or the like. In some instances, however, the texturizing machine includes a heating means both preceding and following the false twist imparting means, and such machines are used for the production of set yarns, the elongation of which is substantially reduced by the thermal stabilization and shrinkage treatment which occurs while the yarn is under tension. Yarn heating apparatus of the described type are normally electrically heated, for example by an external resistance heater, or they may be heated by hot air or a suitable fluid heating medium. For example, U.S. Pat. No. 4,001,548 discloses a yarn processing apparatus which comprises a number of heater tubes positioned in a side by side arrangement, and wherein the yarns are guided through individual tubes, with the tubes being heated by the hot vapor of a vaporizable heat transfer fluid.

The heating effect of so called "tubular heaters" is proportional to their length within the range of practical lengths. At high yarn speeds, it is difficult to accommodate the required length of the tube in the available space, and as an improvement, it has been suggested that hot air be blown into the tubes, note for example German OS No. 33 06 459. However, to accomplish this arrangement, high initial engineering costs are required, and the loss of energy is significant. Also, differences in temperature may be experienced from position to position on the machine, if the temperature of the blown hot air varies from position to position. Therefore, substantial technical control equipment is needed to provide a constant temperature for the hot air at each heater, and uniform conditions from heater to heater.

It is accordingly an object of the present invention to provide a yarn heating apparatus and method of the described type, and which overcomes the above-noted disadvantages and limitations of the prior art devices.

It is also an object of the present invention to provide a yarn heating apparatus and method which achieves improved heat transfer from the heating tube to the yarn, and which achieves uniform heating conditions at each of a plurality of yarn heating positions on a yarn processing machine.

It is a more particular object of the present invention to provide a yarn heating apparatus and method which reduces the heat requirements for a given quantity of yarn production, and which achieves efficient heat transfer from the heated air to the yarns.

These and other objects and advantages of the present invention are achieved in the embodiment illustrated herein by the provision of an apparatus and method which includes a yarn guide tube adapted to have a running yarn conducted therethrough, with the tube defining a yarn entry end and a yarn exit end, and means for heating the exterior of the yarn guide tube so as to heat the running yarn as it passes therethrough. In addition, the apparatus includes means for positively introducing air into the yarn guide tube adjacent the entry end thereof, and so as to produce turbulence in the air as it moves through the tube and thereby improve heat transfer between the tube and the running yarn. Preferably, the air is introduced in the form of a pressurized high velocity air stream.

The air which is introduced into the tube is preferably fresh outside ambient air at ambient temperature, and the use of such air has several advantages as compared to the use of hot air, namely, the fresh ambient air is readily available at any location, it will have a more uniform temperature from position to position of the machine, and any pressure fluctuations which may occur can be readily corrected by providing an adjustable control for the pressure of the air. While it might have been expected that blowing fresh ambient air into the yarn guide tube would cause cooling of the yarn rather than improve the heating effect, it has surprisingly been found that any cooling of the yarn is more than overcome by a considerably improved heat transfer to the running yarn.

The fresh ambient air may be introduced in the form of a single jet positioned at the entry end portion of the yarn guide tube, with the jet extending in a direction which transversely intersects the running direction of the yarn. Preferably, the fresh ambient air is supplied to the yarn guide tube through an injector assembly, which is mounted adjacent the entry end of the guide tube. The injector assembly is designed to provide a high velocity stream of ambient air which enters the entry end of the yarn guide tube, with the cross section of the stream being less than the cross section of the yarn guide tube, thereby causing turbulence of the expanding air stream. In a preferred embodiment, the air stream is introduced into the yarn guide tube through a conical ring-shaped duct which concentrically surrounds the yarn. The injector assembly comprises two components, namely a fixed block having a bore extending therethrough, and a nozzle mounted within the bore of the block. The bore of the block includes an inner portion of conical cross section, and the nozzle includes a conical forward end portion positioned adjacent the conical inner portion of the mounting cavity, to define the above described conical duct therebetween, which serves as a part of the air supply means. The nozzle of the injector assembly includes a central yarn passage which is coaxially aligned with the entry end of the yarn guide tube, so that the running yarn is adapted to pass through the injector assembly and then through the heated yarn guide tube.

The air supply means includes an air delivery line for delivering pressurized ambient air to the injector assembly, together with an annular chamber in the injector assembly which is in communication with the air delivery line and the upstream end of the conical duct formed in the injector assembly. Thus the pressurized air moves through the air delivery line into the annular chamber, then through the conical duct and into the entry end of the yarn guide tube.

The conical duct formed between the conical inner portion of the bore in the block and the forward end portion of the nozzle, terminates at a shoulder formed in the block, and so as to surround the relatively narrow outlet of the yarn passage through the nozzle. As a result, a suction is created at the outlet of the yarn passage, which tends to draw the yarn through the nozzle to thereby facilitate the threading operation. To further facilitate the threading operation, it is also possible to increase the flow rate of the fresh ambient air during the threading operation.

The heat transfer as provided by this invention can be further enhanced by providing a relatively narrow entrance portion of the heating tube. It is a theory of this invention that the air jet of ambient fresh air introduced into the heating tube serves to destroy a sheath of ambient air which is carried along by the running yarns and forms an insulating casing on the yarn. It will thus be understood that the yarn should not carry a large quantity of ambient air into the heater, by reason of the tendency of the ambient air to form an insulating casing. For this reason, the inlet portion of the yarn passage of the nozzle, or the inlet end of the yarn guide tube is relatively narrow so that the ambient air entrained by the yarn is stripped before entering the yarn guide tube.

The supplied fresh ambient air may be metered, for example by a magnetic valve in the inlet delivery line, as well as by a metering device associated with each injector assembly. This metering device may take the form of an adjustable connection between the block and nozzle of the injector assembly, whereby the size of the conical duct may be adjusted.

The heated internal yarn passageway through the yarn guide tube is preferably provided with protuberances, such as knobs, bulges, rings, or the like over its entire circumference and length. Such protuberances result in additional turbulence in the air, and the heat transfer to the yarn is enhanced. This construction also provides a substantial improvement in the setting effect of the heating apparatus, and to accomplish a high quality and uniformity of the crimped yarns, at a high production speed.

Some of the objects and advantages of the invention having been stated, others will appear as the description proceeds when take in conjuction with the accompanying drawings in which—

FIG. 1 is a sectional side elevation view of a yarn heating apparatus which embodies the features of the present invention; and FIG. 2 is a diagram illustrating the air consumption vs. crimp for an apparatus embodying the present invention.

Referring more particularly to the drawings, FIG. 1 illustrates a yarn heating apparatus 10 which embodies the features of the present invention. In this regard, it will be understood that a conventional yarn processing machine will include a plurality of such heaters mounted in a side by side, vertical arrangement, as further disclosed for example in U.S. Pat. No. 4,001,548.

Each heating apparatus 10 includes a yarn guide tube 12 having an internal passageway 13 through which the running yarn is adapted to be conducted in the direction 14, with the tube 12 thus defining an upper or entry end 15 and an opposite exit end 16. A second tube 18 coaxially surrounds the tube 12, and the tube 18 is welded to the top and bottom of a heater box 20. The heater box includes a vaporizable heat transfer fluid 21 and heater 22, as further disclosed in the above-referenced prior U.S. patent, and thus the heat is transfered from the vaporized fluid across the tubular space 23 and to the yarn guide tube 12, with the space 23 and tube 12 being designed for good heat transfer. The heat is then transfered from the yarn guide tube 12 to the yarn in the initial passageway 13, primarily by convection, since there is little contact between the running yarn and the wall of the tube 12. The inner periphery of the passageway 13 is provided with protuberances 24 around its entire circumference and along its entire length, which serve to interrupt the air flow in the direction of the running yarn, thereby creating turbulence and improved heat transfer to the yarn.

The yarn heating apparatus 10 of the present invention further includes air supply means for positively introducing air into the yarn guide tube 12 adjacent the entry end 15 thereof. In the illustrated embodiment, the air supply means includes an injector assembly 25 mounted adjacent the entry end of the yarn guide tube 12, and the injector assembly includes a fixed mounting block 26 having a bore extending therethrough which is aligned with the entry end 15 of the yarn guide tube 12. The bore of the block includes a cylindrical internally threaded upper portion 28, an annular chamber 29 positioned below the threaded upper portion, and an inner portion 30 of conical cross section positioned below the chamber 29 and which tapers inwardly in a direction toward the yarn guide tube 12. The inner or downstream end of the conical inner portion 30 merges into a lower cylindrical portion 31 of the bore, which in turn communicates with a shoulder 32 formed at the lower end of the block 26 for accommodating the upper ends of the tubes 12 and 18.

The injector assembly 25 further includes a nozzle 34 mounted in the bore of the block 26, and the nozzle 34 includes a central yarn passage 36 therethrough which is coaxially aligned with the entry end 15 of the yarn guide tube 12. In addition, the nozzle 34 includes an externally threaded rear portion 37 which is threadedly received in the upper portion 28 of the bore of the block, and the nozzle 34 further includes a conical forward end portion 38 which is positioned immediately adjacent but axially spaced from the conical inner portion 30 of the bore of the block 26, to define a conical duct 40 therebetween. The nozzle 34 also includes a knob 41 having an indicator 42 fixed thereto.

The air supply means of the heating apparatus includes an air delivery line 44 which communicates with the annular chamber 29, by which fresh ambient air may be introduced. The supply of this air can be regulated by rotating the nozzle 34 with respect to the block 26, by which the space between the conical inner portion 30 of the bore and the conical forward portion 38 of the nozzle may be adjusted, to thereby adjust the width of the duct 40. The knob 41 is adapted to facilitate this rotational movement of the nozzle.

The line 44 is connected to a source of pressurized ambient air, via a cut-off valve 46 which is operatively connected to a yarn sensor 47. The fresh ambient air is preferably supplied at a constant temperature, i.e. ambient or room temperature, by a suitable compressor 48, and the air flows through the injector assembly and into the passageway 13 of the yarn tube 12. As is apparent from the drawing, the cross-section of the conical duct 40 formed between the inner portion 30 of the bore and the forward end portion 38 is smaller at its exit into cylindrical portion 31 than the cross-section of this cylindrical portion 31. Therefore, the stream of air leaving the conical duct 40 will expand and thereby become turbulent. The yarn entering through passage 36 of the nozzle will carry along a stream of ambient air, which upon entering into the cylindrical portion 31 will also expand and be disturbed and destroyed by the turbulence of the other air stream. It is the theory of this invention that by the air flow through duct 40 turbulence arises which causes a back and forth motion of the air between the walls of the yarn guide tube and the yarn and, furthermore, a mixing of the air entering the yarn guide tube. Thereby, the heating effect of the yarn guide tube is improved in spite of the relatively small amount of introduced ambient air which tends to cool the yarn. It is possible to find an optimum for the amount of the introduced air to maximize the improvement of heat transfer.

FIG. 2 is a diagram illustrating a test result, with the ordinate representing the crimp of a false twist textured and heat set yarn, and the fresh air consumption of the nozzle assembly being indicated on the abscissa. Heat setting was effected in a first test with the introduction of fresh air in the manner described above, and in another test without the fresh air and without changing any other test parameter. The crimp is illustrated in accordance with German industrial standard (DIN 53840), and it is evident that as the introduction of fresh ambient air increases, a clearly better crimp of the yarn is achieved, as compared to the test with no introduced air. In the illustrated test, an improvement first occurred when fresh ambient air was introduced at a rate of about 0.5 standard cubic meters per hour, and the test demonstrates that the heat transfer to the yarn in the yarn guide tube 12 is considerably improved with the introduction of fresh ambient air, thereby accomplishing a substantially better heat setting of the yarn.

In the drawings and specification, there has been set forth a preferred embodiment of the invention, and although specific terms are employed, they are used in a generic and descriptive sense only and not for purposes of limitation.

That which is claimed:

1. A yarn heating apparatus adapted for the continuous heat treatment of a running synthetic yarn in a yarn processing machine and the like, and compromising a yarn guide tube through which a running yarn is adapted to be conducted, with said tube closely surrounding the yarn so as to guide the yarn along a substantially straight path, and with said tube defining a yarn entry end and a yarn exit end, means for heating the yarn guide tube so as to heat the running yarn as it is conducted therethrough, and air supply means for positively introducing air at ambient temperature into said yarn guide tube adjacent the entry end thereof and so as to produce turbulence in the air as it moves through said tube and thereby improve heat transfer between said tube and the running yarn, said air supply means including a source of pressurized air at ambient temperature, and air duct means operatively connected to said source of pressurized air and which communicates with the path of the running yarn at an inclined angle.

2. The yarn heating means as defined in claim 1 wherein said air duct means comprises a conical duct which concentrically surrounds the path of the running yarn and narrows in the direction of the running yarn.

3. The yarn heating means as defined in claim 2 wherein said air supply means includes an injector assembly mounted adjacent the entry end of said yarn guide tube, said injector assembly including yarn passage means for the passage of the running yarn therethrough, and wherein said conical duct is positioned within said injector assembly so as to concentrically surround said yarn passage means and such that the outlet end of said conical duct is immediately adjacent the entry end of said yarn guide tube.

4. The yarn heating apparatus as defined in claim 1 wherein said air supply means includes an injector assembly mounted adjacent the entry end of said yarn guide tube, said injector assembly including a fixed mounting block having a bore extending therethrough which is aligned with the entry end of the yarn guide tube, and a nozzle mounted in said bore and having a central yarn passage therethrough which is coaxially aligned with the entry end of said yarn guide tube.

5. The yarn heating apparatus as defined in claim 4 wherein said bore of said block includes an inner portion of conical cross section which tapers inwardly in a direction toward said yarn guide tube, and said nozzle has a conical forward end portion positioned immediately adjacent but axially spaced from said conical inner portion of said bore to define a conical duct therebetween which communicates with said entry end of said yarn quide tube and which forms a portion of said air duct means, and such that the air advances through said conical duct and into said entry end of said yarn guide tube.

6. The yarn heating apparatus as defined in claim 5 wherein said nozzle is threadedly mounted in said bore of said block, such that the nozzle may be adjustably positioned in said bore to vary the width of said conical duct.

7. The yarn heating chamber as defined in claim 1 further including means for sensing the presence of a yarn being conducted through said heating apparatus, and valve means operatively controlled by said yarn sensing means for terminating the operation of said air supply means upon a yarn break being detected.

8. The yarn heating apparatus as defined in claim 1 wherein said means for heating the yarn guide tube comprises a heater box enclosing substantially the entire length of said yarn guide tube, a vaporizable fluid disposed in said heater box, and means for heating said fluid so that substantially the entire length of said yarn guide tube is heated by the hot vapor of said fluid.

9. The yarn heating apparatus as defined in claim 1 wherein said yarn guide tube includes an internal passageway gor receiving the running yarn, and said internal passageway includes a plurality of inwardly projecting protuberances which serve to narrow the cross section of said central passageway and impart further turbulence to the air passing therethrough.

10. A method of heating a running yarn and comprising the steps of guiding the running yarn along a substantially straight path through an elongate yarn guide tube, while heating the yarn guide tube so as to heat the yarn passing therethrough, and while positively introducing air at ambient temperature into said yarn guide tube adjacent the end thereof into which the yarn enters and so as to produce turbulence in the air as it moves through the yarn guide tube and thereby improve heat transfer between the tube and the running yarn, and such that the introduced air moves completely through said yarn guide tube.

11. The method as defined in claim 10 wherein the step of positively introducing air into the yarn guide tube includes introducing the air so that it contacts the running yarn at an inclined angle with respect to its running direction.

12. The method as defined in claim 11 including the further step of initially threading the running yarn through the yarn guide tube while introducing the ambient air into the yarn guide tube at a flow rate greater than that employed during normal heating of the running yarn, to thereby facilitate yarn threadup.

13. The method as defined in claim 10 comprising the further step of monitoring the running yarn to detect a break thereof, and terminating the introduction of air into the yarn guide tube upon detection of a yarn break.

14. The method as defined in claim 10 wherein the step of heating the yarn guide tube includes surrounding the exterior of the tube with a heater box having a heated vapor therein, and such that the heat of the vapor is transferred to the exterior of said tube.

15. The method as defined in claim 10 wherein the step of positively introducing air into said yarn guide tube includes maintaining the introduced air out of heat exchange relationship with the yarn guide tube prior to being introduced thereinto.

* * * * *